US007617780B2

(12) United States Patent
Loebner

(10) Patent No.: US 7,617,780 B2
(45) Date of Patent: Nov. 17, 2009

(54) DUAL ASPECT PORTABLE FLOOR

(76) Inventor: Hugh Gene Loebner, 220 W. 98th St., #2B, New York, NY (US) 10025

( * ) Notice: Subject to any disclaimer, the term of this patent is extended or adjusted under 35 U.S.C. 154(b) by 0 days.

(21) Appl. No.: 11/506,938

(22) Filed: Aug. 21, 2006

(65) Prior Publication Data

US 2008/0121145 A1 May 29, 2008

(51) Int. Cl.
*A47B 13/00* (2006.01)
*F21S 8/00* (2006.01)

(52) U.S. Cl. ..... 108/158.11; 108/23; 362/153; 248/129

(58) Field of Classification Search ..... 362/153, 362/85, 253; 108/23, 50.11, 50.17, 124, 108/158.11; 248/129
See application file for complete search history.

(56) References Cited

U.S. PATENT DOCUMENTS 4,120,025 A * 10/1978 Deaven ..... 362/153
5,412,890 A * 5/1995 Fechter ..... 40/414

* cited by examiner

*Primary Examiner*—John A Ward

(57) ABSTRACT

Portable floors can have casters on two separate sides. This allows the floors to roll when in a flat aspect suitable for dancing and when in a tall aspect suitable for passing through narrow passages.

6 Claims, 7 Drawing Sheets

DUAL ASPECT PORTABLE FLOOR

BACKGROUND OF THE INVENTION

This invention relates to portable dance floors. Specifically, it relates to portable dance floors which permit entertainers to perform "pole dances," that is, to perform dances for the entertainment of viewers. During a pole dance, the entertainer holds on to a vertical pole and, while holding on, performs various gyrations for the entertainment of the viewers. Such dances are popular in so-called "Gentlemen's Clubs." However, some people perform pole dances as part of an exercise routine, and some gyms (and dance studios) provide lessons in pole dancing.

There are numerous designs for portable dance floors. Letters patent 375563 and U.S. Pat. No. 4,329,739 are for dance floors comprising extruded plastic strips joined along the edge. However, these inventions do not permit affixing a pole for the dance.

Another design for portable dance floors involves multiple sections or pieces joined together. For example U.S. Pat. Nos. 4,303,969; 4,635,425; 5,465,546; 5,634,309; 6,128,881; 6,189,283; and 6,684,592 all involve multiple components that can be assembled to form a dance floor. However, none of these provides means to secure a pole which a performer can use in the course of his or her dance.

There are commercially available portable dance floors for pole dances. For example, the Platinum Stages corporation provides 4'×4'×1' dance floors with a removable pole, some of which have casters. Those portable dance floors provided by Platinum Stages which have casters have them on the bottom only. Since these floors are 4'×4' when rolling they can not be rolled through doors or narrow passages.

SUMMARY OF THE PRESENT INVENTION

My invention comprises a rolling dance floor having dimensions of approximately 4 feet×4 feet×1 foot, said floor having a removable pole and two sets of rolling means such as casters. One set of casters is affixed to the "bottom" of the dance floor and the other set is affixed to a side orthogonal to the bottom. The "bottom" set of casters allows the floor to be moved when in a "flat" aspect, that is, when the 4'×4' plane is horizontal. The second set of casters, affixed to a 1'×4' side orthogonal to the 4'×4' face allows the floor to be rotated 90 degrees vertically and rolled in a "tall" aspect.

An additional advantage of my invention is that the floor has at least one extendable drawer contained within the floor. The drawer, when extended can provide footlights to illuminate the performer. Said drawer can also contain a mini-sound system for the performer to dance to, and/or storage space for the personal effects of the performer.

DESCRIPTION OF THE PREFERRED EMBODIMENT

Figure 1:
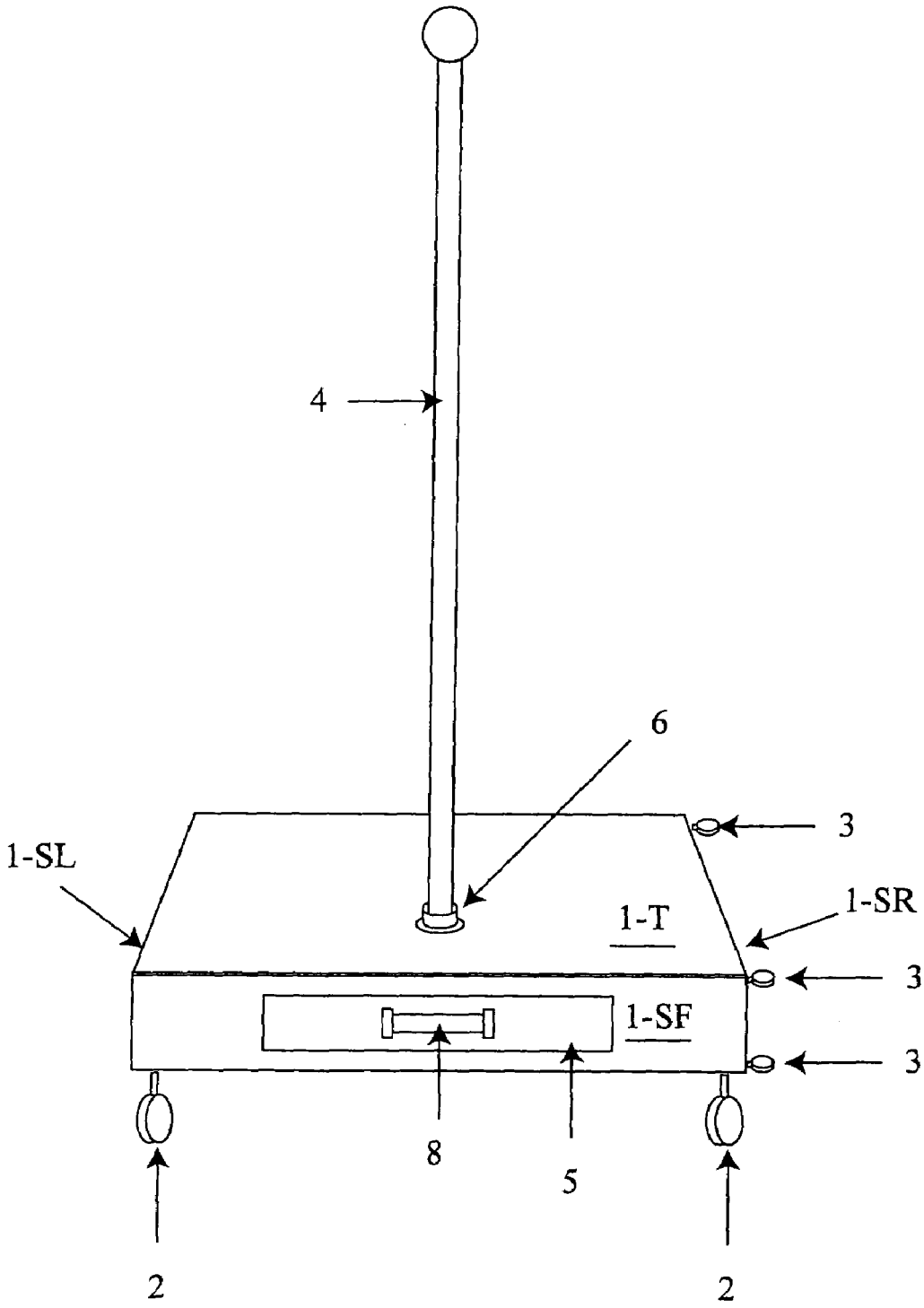
FIG. 1 is a view of the floor in the "flat" aspect suitable for dancing.

FIG. 1 shows the floor in "flat" aspect. Dance pole 4 protrudes perpendicularly to the plane 1-T comprising the top of the floor when in the "flat" aspect. Pole 4 is typically 2" OD brass or chrome with a wall thickness of 0.05" with a length of 7'. Pole 4 is guided through dance surface 1-T by flange 6. The set of rolling means such as casters 2 are affixed to the bottom of the floor. Only the front pair of casters of castor set 2 is shown. A second set of rolling means casters 3 is affixed to a side 1-SR. The front surface of drawer 5 is shown with drawer handle 8.

Figure 2:
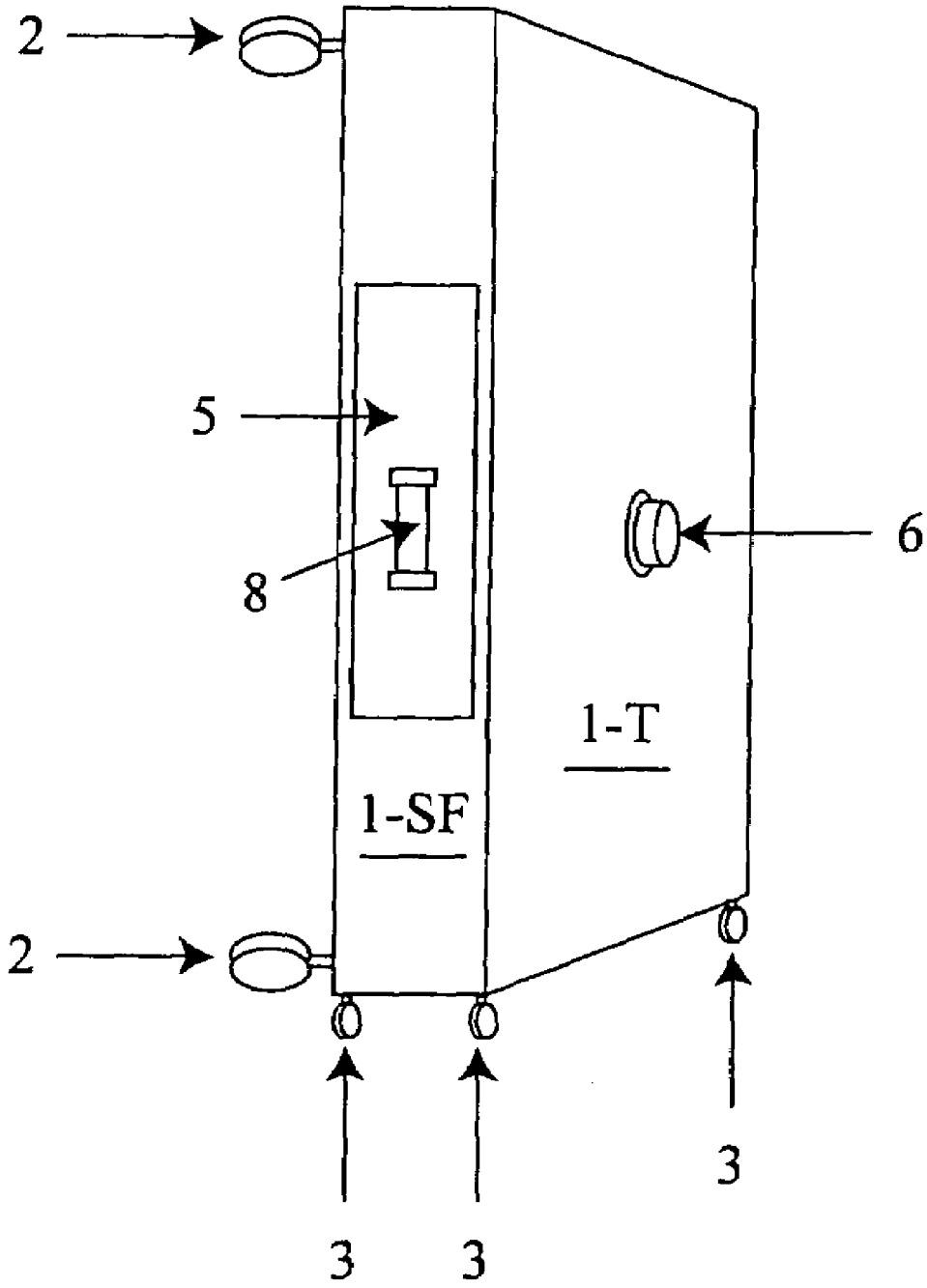
FIG. 2 is a view of the floor in the "tall" aspect, suitable for rolling through doorways.

FIG. 2 shows the floor in its "tall" aspect. In this view, the floor has been rotated 90 degrees so that castor set 3 is on the bottom. Removable dance pole 4 has been removed. It can be seen that in this "tall" aspect the dance floor can pass through any doorway wider than is the floor when in this aspect. It would also be capable of passing between tables in a dining environment. In the preferred embodiment, side 1-SR is 1'×4' and the casters are 6" high, so the floor will pass through any doorway or passage wider than 1'6".

Figure 3:
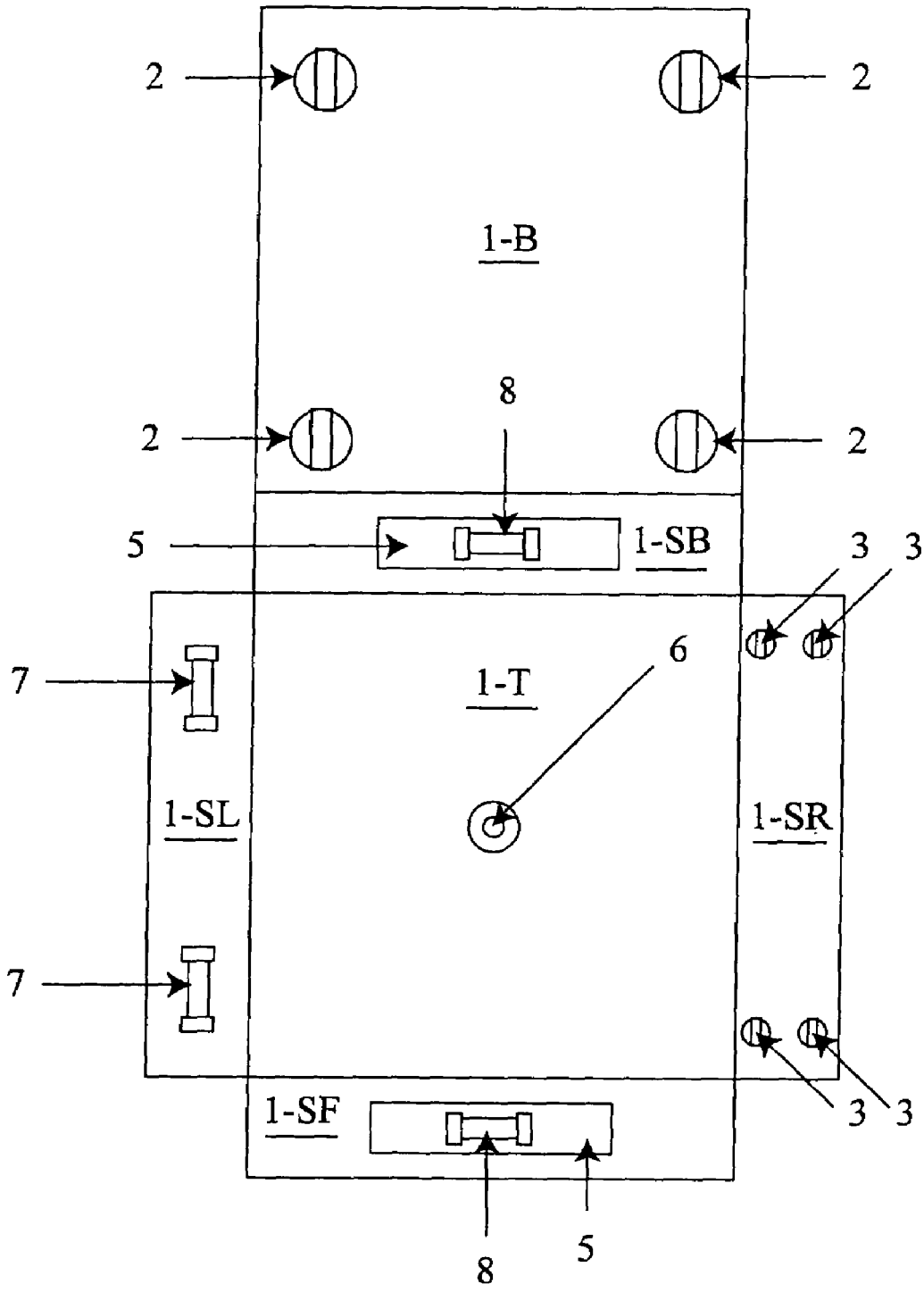
FIG. 3 is an "unfolded" view of the 6 faces of the dance floor, showing the disposition of surface elements and how they are numbered in this disclosure.

FIG. 3 shows the planes of the floor in an "unfolded" state. Plane 1-T comprises the top of the dance floor when in the floor is disposed in the "flat" aspect. Attached to plane 1-T is flange 6. The center of flange 6 encircles a hole in plane 1-T which permits pole 4 to penetrate said surface. Plane 1-B comprises the bottom surface when in the flat aspect. Affixed to the corners of plane 1-B are 4 casters 2. Planes 1-SF, 1-SR, 1-SB, and 1-SL are orthogonal to sides 1-T and 1-B. Attached to side 1-SR are casters 3 used to roll the floor when in the "tall" aspect. Attached to side 1-SL, which is opposite side 1-SR, are handles 7 which are use to lift the dance floor from the "flat" aspect to the "tall" aspect. Drawers 5 with drawer pulls 8 are located in sides 1-SF and 1-SB and are shown in the retracted state. I have found that using ¾" thick plywood serves for sides 1-T and 1-B, and that ½" thick plywood serves for sides 1-SR, 1-SF, 1-SL, and 1-SB.

Figure 4:
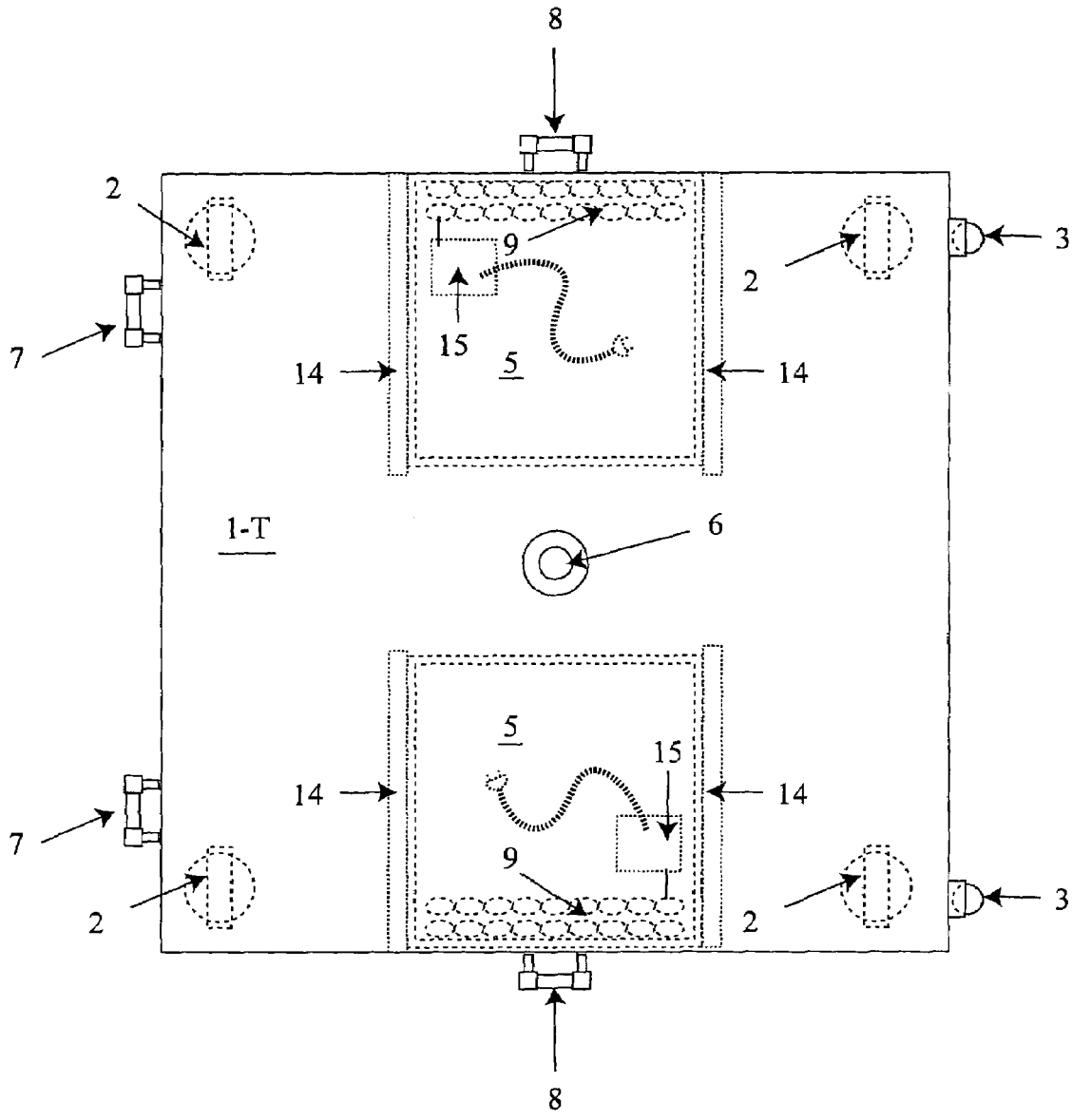
FIG. 4 is a top view of the floor.

FIG. 4 is a top view of the dance floor showing the disposition of the internal components of the floor. Guide strips 14 allow Extendable storage means 5 to be extended from the body of the floor using pulls 8 to extend said means. Extendable storage means 5 have light sources 9 powered by power source 15 I have found that commercially available light strips comprising high intensity LEDs are a suitable light as footlights for performers. One example of such light strips is Agilight "BrightStrip"™ which require only a 12V electrical supply. I have found Radio Shack AC adapter model 273-1776 12V power supply to be a suitable power source for light strips 9. FIG. 4 shows the disposition of handles 7 opposite casters 3. Also shown in FIG. 4 is the disposition of casters 2 which are affixed to the bottom of the floor when in "flat" aspect. Also shown is flange 6 located in the center of side 1-T.

Figure 5A:
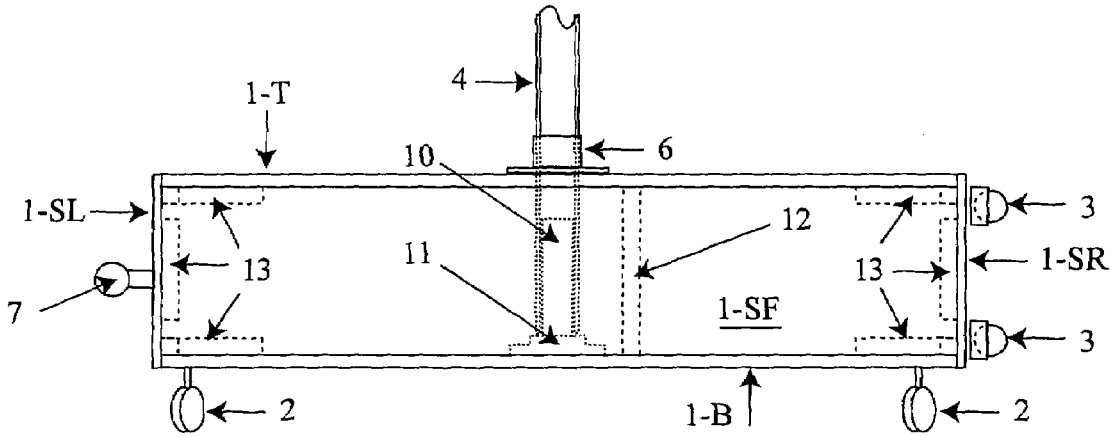
FIG. 5*a* is a side view of the floor when in the "flat" aspect.

FIG. 5*a* shows a side view of the dance floor in "flat" aspect. Affixed to the bottom of the floor 1-B by bolts is malleable iron flange 11. Support post 10 screws into flange 11. Such a combination is commercially available. For example, Crown Industries' item A717 wood reinforcement comprises such a combination of flange and support post. Support post 10 is threaded to be capable of being screwed into flange 11. The diameter of post 10 is such that pole 4 can slip over post 10. I have found that IMC electrical conduit, cut to a 1' length and threaded to screw into malleable iron flange

11 serves. Also shown in FIG. 5*a* are wood struts 13 arranged along z, y, and z coordinates. The six sides of the dance floor are joined to form the box structure of the dance floor by being screwed into struts 13 along their edges. I have found that 2"×2"×6" pieces of wood serve as such joining struts. In addition, support post 12, also a piece of wood 2"×2"×1' is screwed between top side 1-T and bottom side 1-B and serves to provide support for side 1-T when an entertainer is performing. Also shown in FIG. 5*a* are lifting handles 7 on face 1-SL opposite to casters 3 affixed to side 1-SR, and casters 2 affixed bottom side 1-B.

Figure 5B:
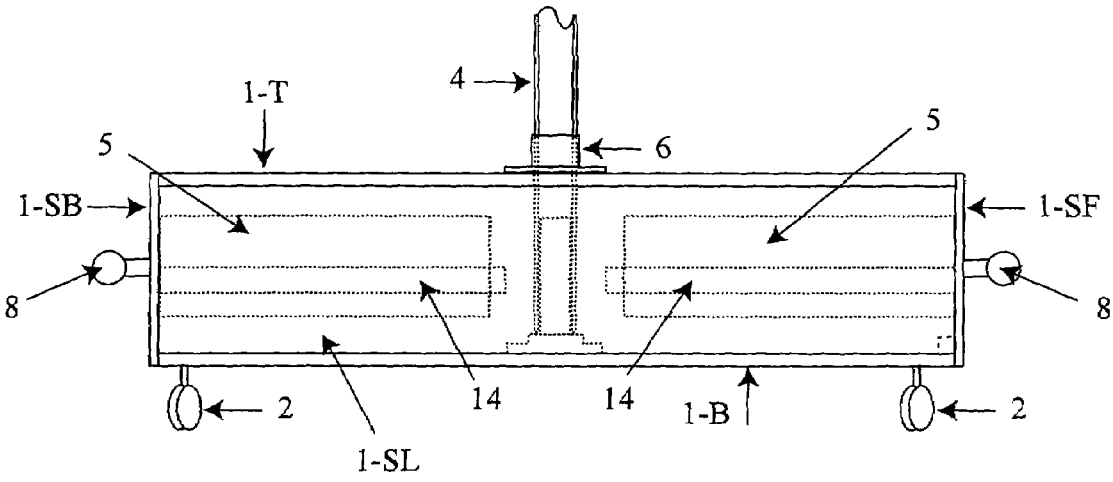
FIG. 5*b* is a side view orthogonal to FIG. 5*a*.

FIG. 5*b* shows a lateral view from a side orthogonal to that of FIG. 5*a*. FIG. 5*b* shows the disposition of drawers 5 guided by guides 14 and drawer pulls 8. In the preferred embodiment of the dance floors drawer pulls 8 and lifting handles 7 comprises End Posts such as Crown Industries' part number P600B supporting a length of 1" OD tubing. Not shown in FIG. 5*b* are joining studs 13 and support 12

Figure 6:
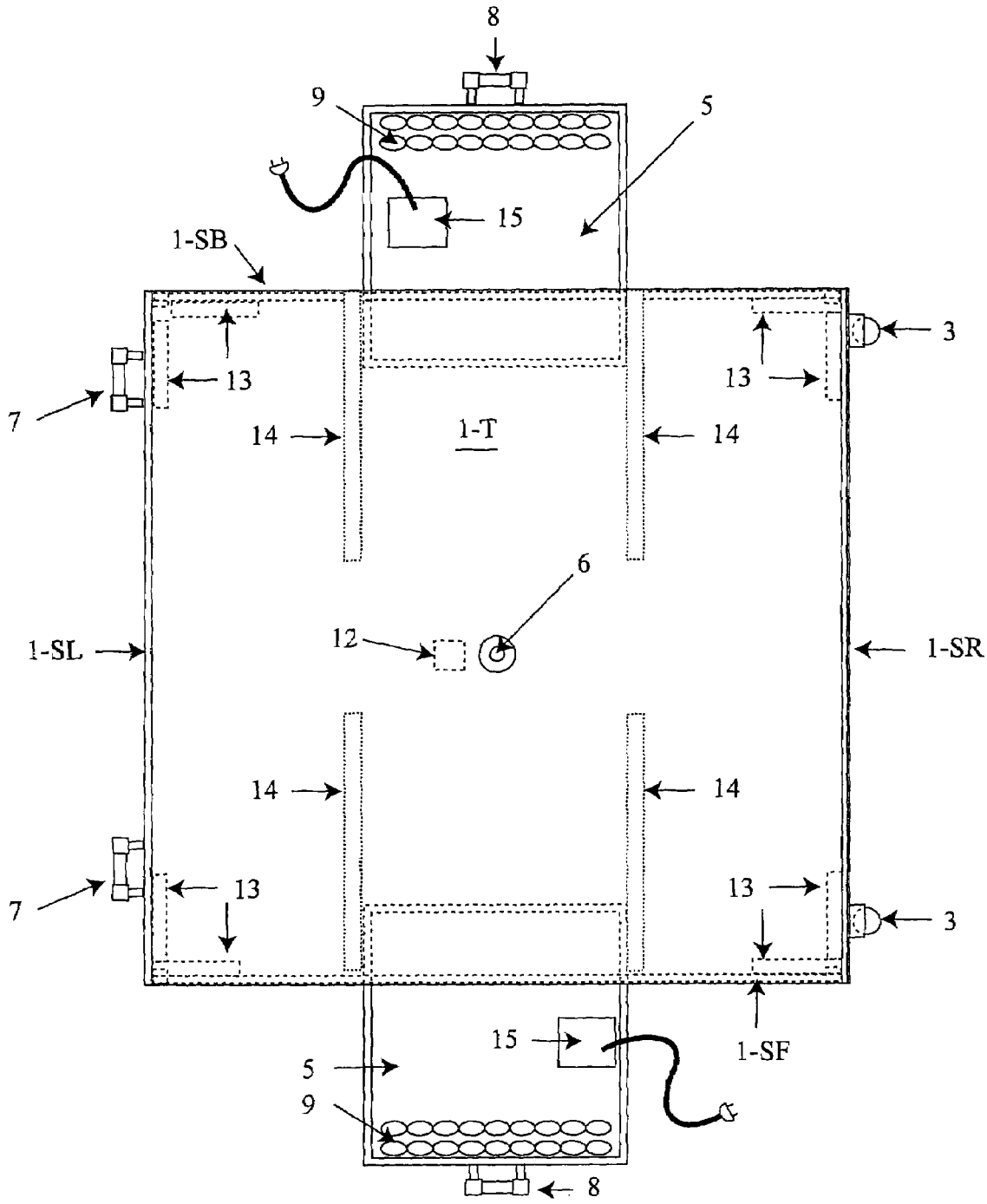
FIG. 6 is a top view showing two extendable storage drawers extended.

FIG. 6 shows a top view of the dance floor in "flat" aspect showing the disposition of drawers 5 when extended to act as footlights. Also shown is support 12 which must be offset slightly from the center to allow flange 6 and post 4 to be placed in the center of the dance floor. FIG. 6 shows two drawers 5 both with lighting. Alternatively, one or both of the drawers can contain a miniature sound system, or remain empty and serve as a storage bin for performers' personal effects.

Figure 7:
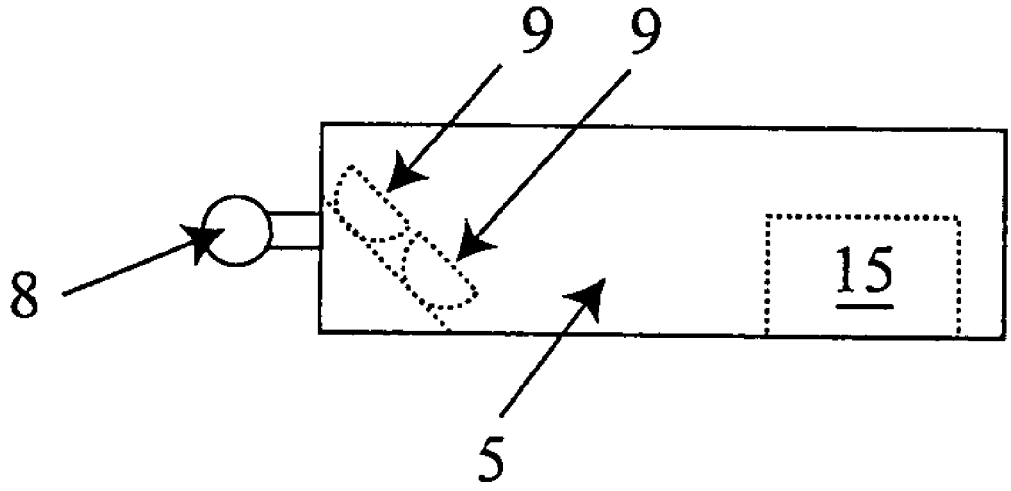
FIG. 7 is a schematic view of one of the drawers, showing how lights may be positioned in the drawer to serve as footlights when the drawer is extended.

FIG. 7 shows a side view of drawer 5 showing the angle of lights 9 so as to light the performer when the drawer is extended from the body of the floor.

It should be noted that although the portable floor revealed in this disclosure is described as being used for portable dances, it can also be used as a podium for models in artist schools. The pole 4, instead of being used for dancing, can be used as support by a model to maintain a pose. In such an application, pole 4 can be considerably shorter than 7'. It must also be noted that the extendable drawers described as containing lighting can also be used to hold audio and other equipment.

I claim:

1. A dual aspect portable dance floor having a flat aspect and a tall aspect;

a) said flat aspect being suitable for dancing and comprising a flat top surface through which a removable dance pole can penetrate; and a bottom surface having a first set of rolling means;

b) said tall aspect being suitable for rolling trough doorways comprising a top surface and a bottom surface, said bottom surface having a second set of rolling means orthogonal to said first set of rolling means.

2. A dual aspect portable dance floor according to claim 1 wherein said two sets of rolling means comprise casters.

3. A portable dance floor according to claim 1 having extendible storage means comprising drawers contained within the floor.

4. A dual aspect portable dance according to claim 3 where said extendible storage means contains lighting means to illuminate a performer.

5. A portable dance floor having extendible storage means comprising drawers contained within the floor.

6. A portable dance according to claim 5 where said extendible storage means contains lighting means to illuminate a performer.

* * * * *